United States Patent [19]

Schrader

[11] 3,995,616

[45] Dec. 7, 1976

[54] ASPHALT KETTLE AND CLOSURE THEREFOR

[75] Inventor: William P. Schrader, Mill Valley, Calif.

[73] Assignee: Cleasby Mfg. Co., Inc., San Francisco, Calif.

[22] Filed: Mar. 17, 1975

[21] Appl. No.: 558,663

[52] U.S. Cl. ..... 126/343.5 A

[51] Int. Cl.[2] ..... E01C 19/45

[58] Field of Search ..... 126/343.5; 432/211; 239/130, 129; 259/155, 156, 157, 158; 404/79, 80; 23/277 C; 220/334, 335, 88 A

[56] References Cited

UNITED STATES PATENTS

| | | | |
|---|---|---|---|
| 490,218 | 1/1893 | Winding | 259/157 |
| 1,757,740 | 5/1930 | Rosner | 220/335 X |
| 2,290,742 | 7/1942 | Elze | 126/343.5 A X |
| 3,220,403 | 11/1965 | Figge | 126/343.5 A |
| 3,252,655 | 5/1966 | Wollner et al. | 126/343.5 A X |
| 3,718,131 | 2/1973 | Busse et al. | 126/343.5 A |
| 3,804,079 | 1/1974 | Schrader | 126/343.5 A |

FOREIGN PATENTS OR APPLICATIONS

| | | | |
|---|---|---|---|
| 1,090,356 | 10/1960 | Germany | 126/343.5 A |
| 8,961 | 4/1893 | United Kingdom | 126/343.5 A |

*Primary Examiner*—William F. O'Dea
*Assistant Examiner*—Harold Joyce
*Attorney, Agent, or Firm*—Naylor, Neal & Uilkema

[57] ABSTRACT

An asphalt kettle having a heating chamber therein for the receipt of asphalt and a three-dimensional closure secured over the chamber. The side walls of the closure are provided with chute-like openings through which asphalt chunks may be loaded into the chamber and these openings are provided with hingedly mounted interior doors which normally assume a closed condition under the influence of gravity and/or the creation of a high pressure condition within the chamber. The closure may lift, within limits, in the event of an explosion in the chamber and a deflection skirt is provided to downwardly direct gas and debris in such event. An induction pipe is connected between the closure and a gas inductor in the stack for the kettle. The pipe is provided with a heat sink to prevent flash-back from the stack into the interior of the kettle chamber.

9 Claims, 7 Drawing Figures

ASPHALT KETTLE AND CLOSURE THEREFOR

BACKGROUND OF THE INVENTION

The present invention relates to a portable asphalt kettle and, more particularly, is directed to improved closure and loading door construction for such a kettle. In its more specific aspects, the invention is concerned with a closure for an asphalt kettle which provides for safe pressure release in the event of an explosion within the kettle and for the withdrawal and disposal of emissions from the kettle.

The prior art relating to closures for portable asphalt kettles is typified by arrangements wherein the closure comprises a relatively large cover hinged at one edge to the top of the kettle so that it may be lifted as a unit for purposes of loading asphalt chunks into the kettle. The cover is typically provided with vents to permit gas to escape in the event of the occurrence of a high pressure condition within the kettle.

Covers of the above-mentioned type are exemplified in U.S Pat. Nos. 2,830,577 and 3,804,079.

Prior art somewhat similar to the closure structure forming the subject of the present invention is also found in the patents relating to closures for chutes and receptacles. Such closures are typically provided to prevent or minimize the inadvertent escape of debris therethrough. The following U.S. patents are representaive of the art relating to such closures: U.S. Pat. Nos. 667,061; 758,354; 1,730,743; 1,757,740; 1,964,513; and 2,149,867.

The present invention is an improvement over the aforementioned prior art in that it provides a closure structure for effectively closing an asphalt kettle against the inadvertent escape of hot asphalt or gas therefrom. As a result, injury to the operators of the kettle as the result of the splashing of hot asphalt during loading of the kettle or in the event of explosion therein is minimized. Furthermore, objectionable gas emissions and heat loss are avoided.

SUMMARY OF THE INVENTION

The kettle of the present invention comprises, in combination: a kettle chamber having a heating means therein to melt asphalt within the chamber; a closure disposed over the chamber and having generally vertically extending side walls with openings therein of sufficient size to permit bulk chunks of asphalt to be loaded therethrough into the chamber; a chute portion fixed relative to each opening and extending inwardly therefrom to terminal edges defining an inwardly and downwardly sloping plane; and, a door hingedly secured above each chute portion for abutting engagement with the terminal edges thereof whereby the doors seal against the edges in the event the pressure to the interior of the closure exceeds that to the exterior thereof. In the preferred embodiment, the closure is secured to the kettle for movement between a first position wherein the closure effectively seals the kettle chamber and the second position at least partially elevated relative to the chamber wherein gas may escape therearound.

A principal object of the present invention is to provide a closure for an asphalt kettle which minimizes the possibility that gas or asphalt may inadvertently escape from the kettle.

Another object of the invention is to provide such a closure which permits the controlled escape of gas from the kettle in the event of an explosion therein.

A still further object of the invention is to provide such a closure which is adapted to cooperate with a gas inducting means to remove gaseous emissions from the kettle and effect the consumption of the emissions.

Another object of the invention is to provide such a closure which minimizes the inadvertent escape of heat from the kettle and, accordingly, conserves the fuel necessary to heat the kettle.

BRIEF DESCRIPTION OF THE DRAWINGS

The foregoing and other objects will become more apparent when viewed in light of the following description and the accompanying drawings, wherein.

DESCRIPTION OF THE ILLUSTRATED EMBODIMENT

Figure 1:
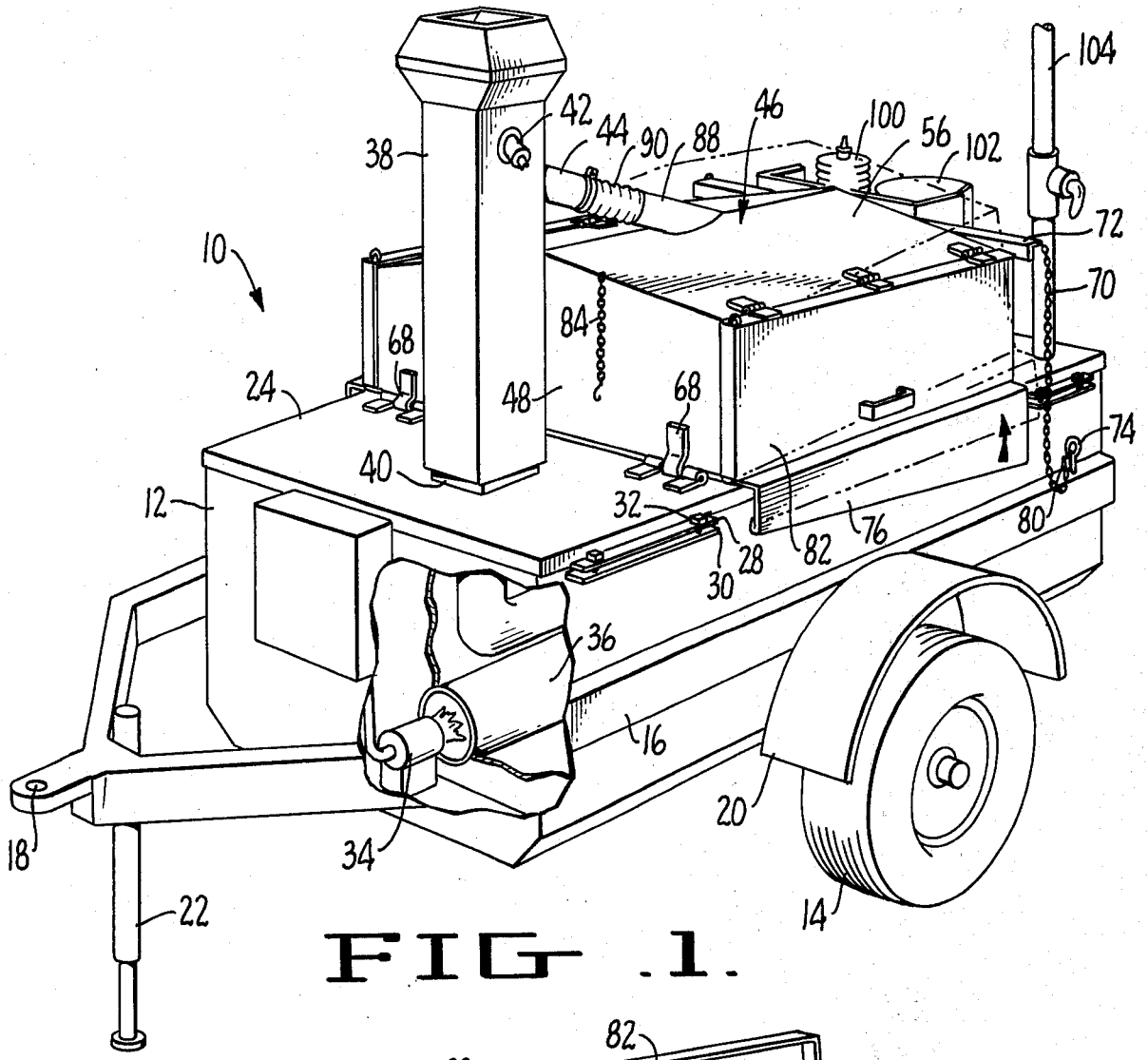
FIG. 1 is a perspective view of an asphalt kettle constructed according to the invention, with parts thereof broken away to show the interior of the kettle.

The kettle illustrated in FIG. 1 is designated in its entirety by the numeral 10 and comprises a kettle chamber 12 supported on a conventional suspension system through means of wheels 14. A framework 16 is fixed to and extends around the kettle and terminates forwardly of the kettle in a towing eye 18. Fenders 20 extend over the wheels 14 and the forward end of the framework is provided with a retractable leg 22 for temporary support of the forward end of the kettle. The kettle, thus described, is a trailer-like vehicle with its center of gravity so positioned that it normally tends to rock forwardly about the axis of the wheels 14.

Kettle chamber 12 is covered by a top 24 having a relatively large open portion 26 extending therethrough. The top 24 is fixedly held to the kettle chamber through means of flanges 28 and 30 fixed to the top and chamber, respectively, proximate the corners of the top, and bolts 32 securing the flanges together. A heater 34 is disposed within the kettle in an isolated compartment at one end thereof so as to direct heating flames into a heating tube 36 extending through the interior of the kettle. As is conventional, the purpose of the heater and heating tube is to elevate the temperature of asphalt contained within the kettle chamber to the melting point. The heating tube 36 traverses back and forth across the length of the kettle chamber and exhausts into a stack 38 fixed to and extending upwardly from the top 24. The stack 38 is of substantially the same construction as the stack shown in my Patent 3,804,079, with the exception that it does not define a passage open to the asphalt contained within the kettle chamber, but rather defines an open area 40 to permit air to be drawn into the stack and around the heat pipe extending thereinto from the heating tube 36. The upper end of the stack 38 is provided with inducting means similar to that of my aforesaid patent, including a burner 42. A conduit 44 communicates with the inducting means in the upper end of the stack to permit emissions from the kettle to be drawn into the stack and consumed. A more detailed description of the structure and function of the conduit 44 will be developed in the following discussion.

Figure 3:
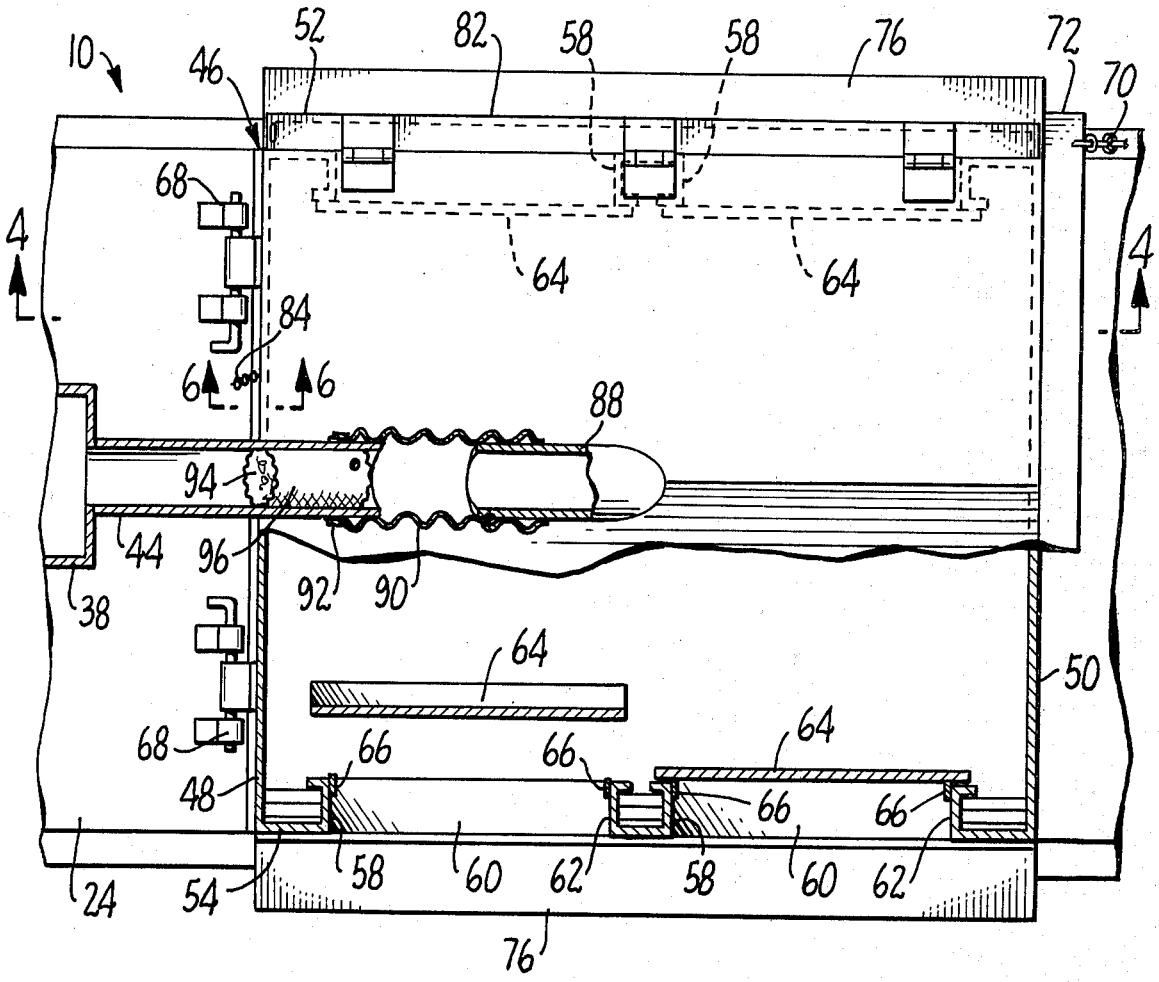
FIG. 3 is a plan view of the kettle, with parts thereof broken away and shown in section.
Figure 4:
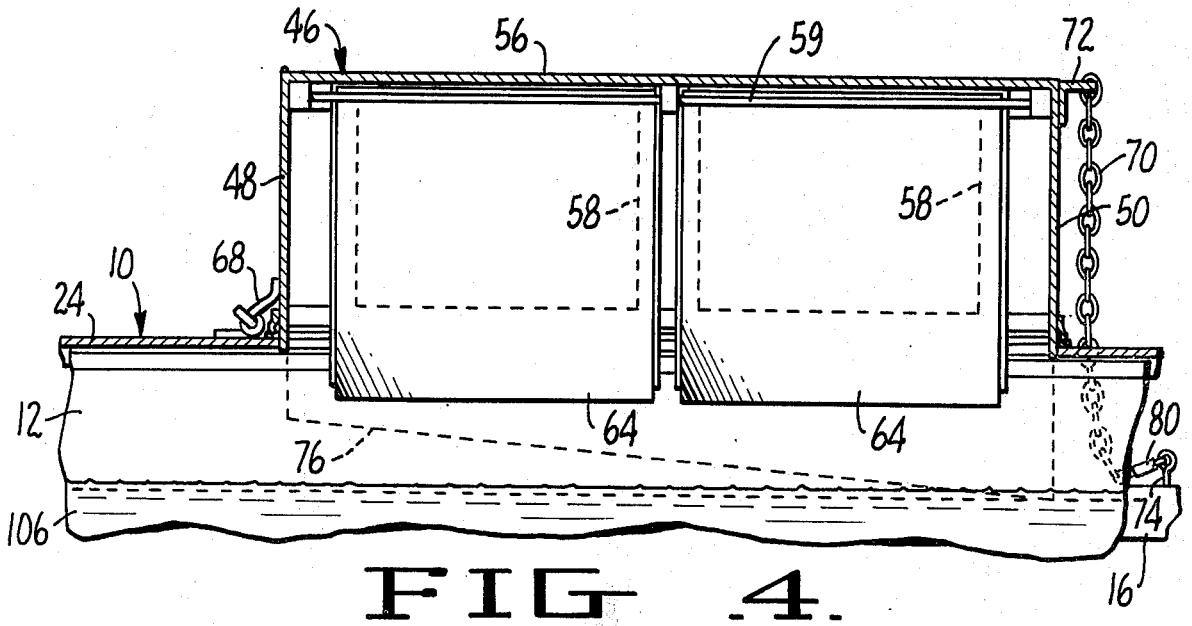
FIG. 4 is a cross-sectional view taken on the plane designated by Line 4—4 in FIG. 3.
Figure 5:
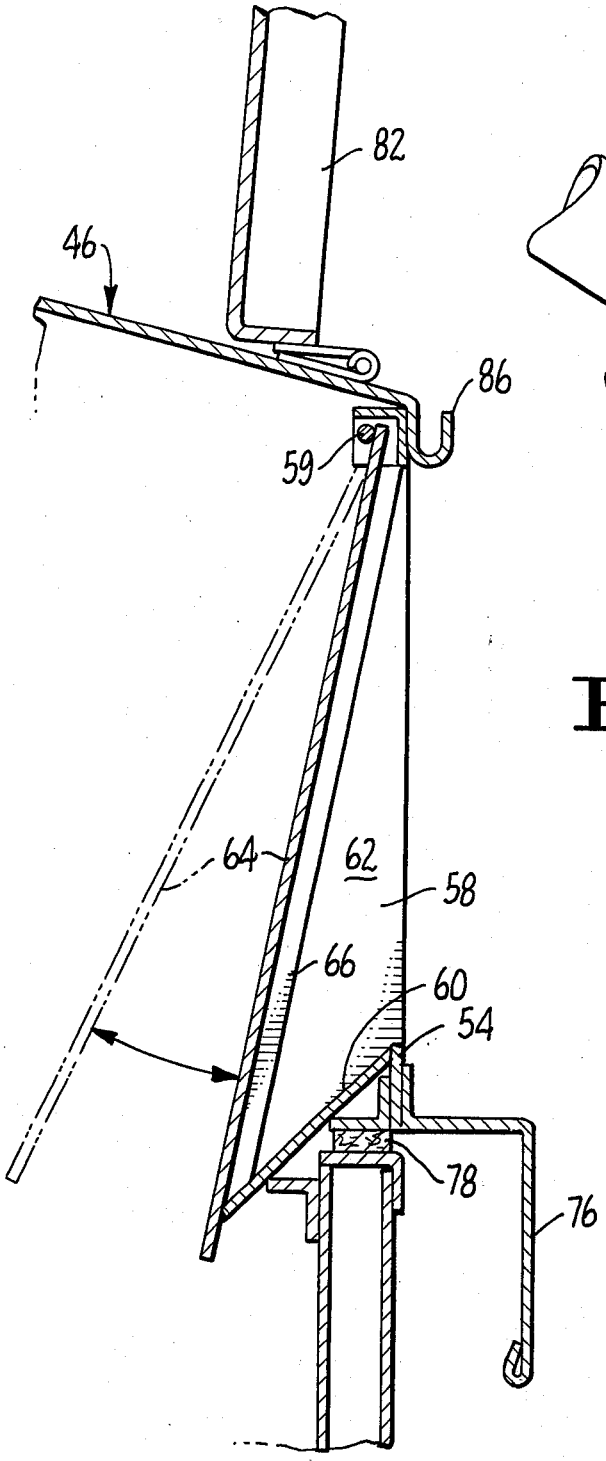
FIG. 5 is a cross-sectional view taken on the plane designated by Line 5—5 in FIG. 2.

The closure of the present invention, designated in its entirety by the numeral 46, is mounted on the top 24 so as to extend completely around and over the open portion 26. The closure comprises a three-dimensional "houselike" structure having end walls 48 and 50, side walls 52 and 54, and a top 56. The side walls 52 and 54 are generally vertical and have formed therein openings 58 of a size sufficient to permit chunks of asphalt to be loaded therethrough and into the interior of the kettle through the open portion 26. The openings 58 are bounded by chutes fixed to the side walls and extending inwardly therefrom. Each chute comprises a downwardly inclined generally rectangular lower wall 60 and lateral walls 62 of generally triangular shape. The inner or distal edges of the lower and lateral walls of the chutes define an inwardly and downwardly inclined plane. Door panels 64 are pivotally secured above each of the openings 58 so that one such panel extends over the chute for each opening and normally rest in abutting engagement with the inner edges of the chute under the influence of gravity. Hinge rods 59 (See FIG. 5) are fixed to the door panels 64 and pivotally supported above the openings 58 to effect pivotal support of the panels. The inner edges of the door panels 64 are provided with flanges 66 (See FIGS. 3 and 5) which extend inwardly of the respective chutes cooperating therewith so as to establish a sealed closure when the door panels are in engagement with the edges of the chutes. The latter interrelationship, together with the abutting interrelationship of the door panels with respect to the edges of the chutes, results in an arrangement wherein any increase in pressure within the kettle (as would occur in the event of explosion therein) functions to force the door panels into secured condition over the chutes.

The forward end of the closure 46 is pivotally secured to the top 24 by hinge joints 68. These joints permit the closure to be pivoted upwardly and forwardly. Safety chains 70 are secured between a beam 72 fixedly secured across the back of the kettle and eyes 74 mounted on the framework 16. These chains limit the degree to which the closure can pivot about the hinge joints. This degree is chosen so that the closure may pivot upwardly to a degree sufficient to permit gas to exhaust around the closure in the event of an explosion within the kettle chamber. Angle-shaped downwardly extending skirts 76 depend from the side edges of the closure (See FIG. 5) to direct gas and debris downwardly in the event of such an explosion. The length of the safety chains 70 is so chosen that the extent of the skirts will not be exceeded on the occasion of the closure lifting during an explosion within the kettle chamber. An asbestos gasket 78 is provided between the top 24 and the lowermost edges of the closure 46 to avoid metal-to-metal contact betweeen the closure and top and assure a sealed joint therebetween when the closure is in the lowered condition.

The lower ends of the safety chains 70 are provided with snap hooks 80 which normally engage the eyes 74, but may be selectively released therefrom to permit the closure to be pivoted to an elevated position in order to enable full access to the interior of the kettle through the open portion 26. The hinge joints 68 are also of the selectively releasable type in order that the closure may be fully removed from the kettle chamber.

Figure 2:
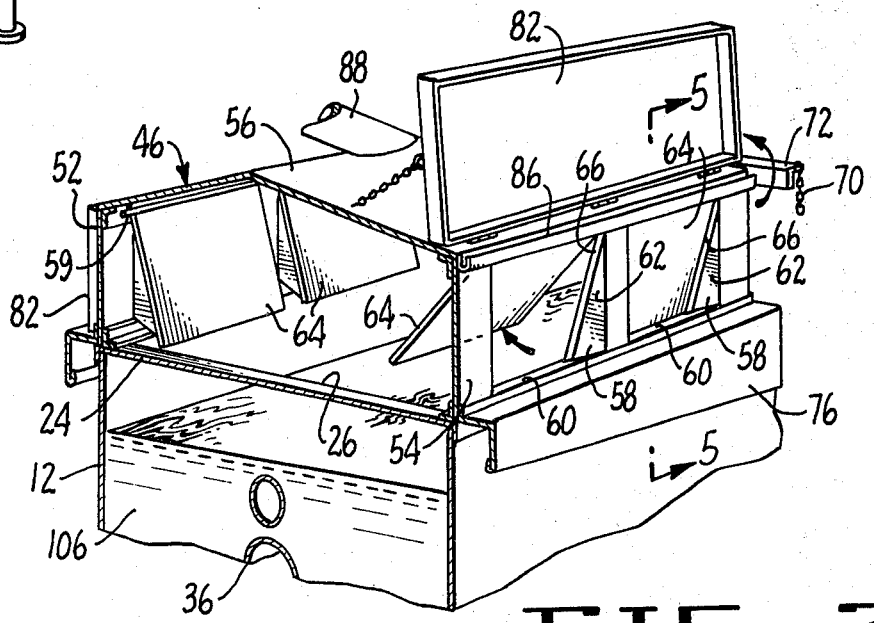
FIG. 2 is a cross-sectional perspective view of the asphalt kettle, with parts thereof broken away, showing the interior construction of the closure.

The structure of the closure 46 also comprises covers 82 hingedly secured to either side of the top 56 for movement between the closed condition, illustrated in FIG. 1, and the open condition, illustrated in FIG. 2. Chains 84 are provided to selectively secure the covers in the open condition. The covers assume the closed condition under the influence of gravity and, if desired, suitable latches might be provided to secure the coovers in the latter condition. The purpose of the covers is to selectively seal the openings 58 from the exterior thereof. This may be desirable in the event of high winds or rain to prevent the door panels 64 from being blown inwardly.

Rain gutters 86 are formed on the lateral edges of the top 56 to catch water which may run from the top so as to prevent such water from running into the openings 58. The covers 82 (as may be seen from FIGS. 2 and 5) are of box-shaped open bottomed configuration and so proportioned that they can extend over the gutters.

Figure 7:
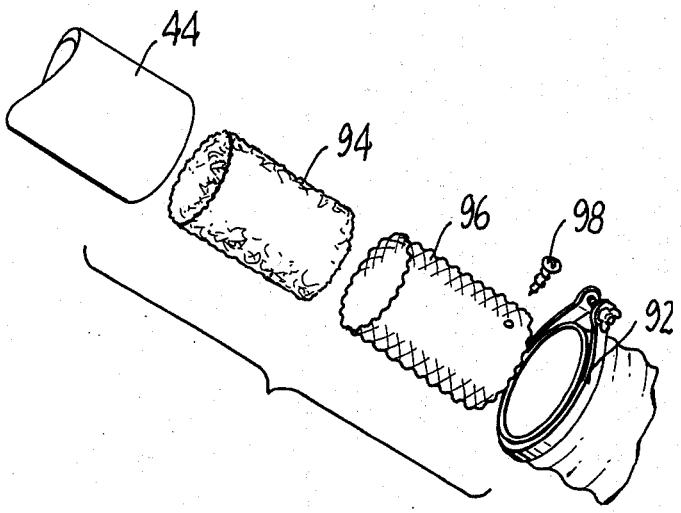
Figure 6:
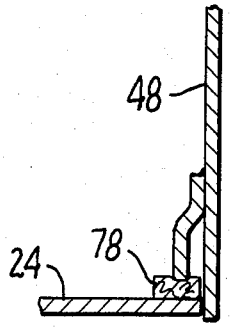
FIG. 6 is a cross-sectional view taken on the plane designated by Line 6—6 in FIG. 3; and, FIG. 7 is an exploded perspective view, with parts thereof broken away, showing the conduit which connects the closure of the kettle to the emission inducting means in the stack of the kettle.

Emissions from the asphalt cotained within the kettle chamber are inducted into the stack 38 through means of a conduit 88 fixed to the top 56 and opening into the interior of the closure 46. The conduits 88 and 44 are secured in fluid communication through means of a flexible sleeve 90 secured therebetween. The sleeve 90 is so proportioned that the conduit 88 telescopes thereinto when the closure is raised about the hinge joint 68. The sleeve 90 is held in place on the conduit 44 through means of a strap 92. The strap 92 may be selectively released to afford access to the interior of the conduits 44 and 88. The latter feature provides means whereby a steel wool heat sink 94 may be selctively inserted into and removed from the conduit 44. The heat sink 94 is contained within a steel mesh cylinder 96 and normally held in place therein by a screw 98 (See FIG. 7).

The purpose of the heat sink 94 is to prevent flashback through the conduits 44 and 88 as the result of the heat of the stack 38. The steel wool of the sink is sufficiently porous to permit the substantially unrestricted flow of gas from the interior of the closure 46 to the emission inducting means of the stack 38.

The basic structure of the kettle 10 also comprises a motor 100, pump 102 and discharge pipe 104. These elements are all of conventional construction and are mounted to the rear of the closure 46.

From the foregoing detailed description, it is believed apparent that the present invention enables the attainment of the objects initially set forth herein. In particular it should be appreciated that the invention provides a closure for an asphalt kettle wherein chunks of asphalt may be loaded into the kettle without the necessity of raising the entire closure and with a minimization of the possibility that asphalt may splash from the kettle. For the sake of illustration, liquid asphalt contained within the kettle chamber is designated in FIG. 2 by the numeral 106. The closure also provides means whereby gas and debris may safely escape from the kettle in the event of an explosion within the kettle chamber, and emissions from the chamber may be efficiently removed therefrom and consumed. The emission removal means minimizes the possibility of an explosion within the kettle chamber.

While the preferred embodiment of the invention has been illustrated and described, it should be understood that the invention is not intended to be limited to the specifics of this embodiment, but rather is defined by the accompanying claims.

I claim as my invention:

1. An asphalt kettle comprising, in combination:

a kettle chamber having heating means therein to melt asphalt contained within the chamber, said chamber having an open top portion;

a closure disposed over the chamber, said closure having opposed spaced vertically extensive side walls, each of which side walls has at least one opening therein of sufficient size to permit bulk chunks of asphalt to be loaded therethrough into the chamber, end walls spanning the space between the side walls and a top extending between said side and end walls;

a chute portion fixed relative to each opening and extending inwardly therefrom, each such chute portion being peripherally sealed around the opening from which it extends and having inner edges defining an inwardly and downwardly sloping plane;

a door hingedly secured above each of said chute portions, said doors being dimensioned for abutting engagement with the edges of the chute portions whereby the doors seal against said edges in the event the pressure to the interior of the closure exceeds that to the exterior thereof;

means securing the closure to the kettle for movement between a first position wherein the closure effectively seals the kettle chamber around the open top portion thereof and a second position at least partially elevated relative to the chamber wherein gas may escape therearound, said means permitting movement of the closure to the second position responsive to pressure within the chamber in the event of an explosion therein;

a skirt fixed to the closure and extending downwardly around the kettle chamber, said skirt being of a length sufficient to extend around the chamber when the closure is in the second position; and, stop means to limit the extent to which the closure can open in the event of an explosion within the chamber to an extent such that when the closure opens to the second position in response to an explosion within the chamber all gas and debris exiting around the closure is deflected downwardly by the skirt.

2. An asphalt kettle, according to claim 1, further comprising flanges secured to and extending outwardly from the doors to assume a position in sealed opposition to the side edges of the chute portions when the doors are in abutting engagement with the edges of the chutes.

3. An asphalt kettle, according to claim 1, wherein said means securing the closure to the kettle comprises a hinge joint between one end of the closure and the kettle.

4. An asphalt kettle, according to claim 3, wherein said stop means comprises at least one lost motion connecting element secured between the kettle and the closure in spaced relationship to the hinge joint.

5. An asphalt kettle, according to claim 3, further including a stack with gas inducting means therein extending upwardly from the kettle to the outside of the hinge joint between the closure and kettle and a conduit connected between said inducting means and the closure, said conduit permitting the unrestricted movement of the closure between the first and second positions.

6. An asphalt kettle, according to claim 4, wherein said connecting element may be selectively released to enable the closure member to be pivoted about said hinge joint to a raised condition affording substantially unrestricted access to the interior of the chamber through the open top portion thereof.

7. An asphalt kettle, according to claim 1, further including:

gas inducting means and means establishing sealed fluid communication between the interior of the kettle chamber and the gas inducting means.

8. An asphalt kettle, according to claim 1, further including:

a stack with gas inducting means therein leading from the heating means within the chamber;

a conduit establishing sealed fluid communication between the interior of the kettle chamber and the gas inducting means; and, heat sink means within the conduit to prevent flashback from the inducting means to the interior of the chamber.

9. An asphalt kettle, according to claim 1, further comprising:

a cover hingedly secured above and to the exterior of each side of the closure for movement between an elevated position affording unrestricted access to the openings in said sides and a lowered position covering the openings in said sides from the exterior thereof.

* * * * *